US006812417B1

(12) United States Patent
Lovell

(10) Patent No.: US 6,812,417 B1
(45) Date of Patent: Nov. 2, 2004

(54) ACTUATOR, METHOD OF MANUFACTURE AND APPLICATION OF USE

(76) Inventor: Walter Carl Lovell, 348 Mountain Rd., Wilbraham, MA (US) 01095

( * ) Notice: Subject to any disclaimer, the term of this patent is extended or adjusted under 35 U.S.C. 154(b) by 0 days.

(21) Appl. No.: 10/445,966

(22) Filed: May 28, 2003

(51) Int. Cl.[7] ..... H01H 35/24
(52) U.S. Cl. ..... 200/61.25; 200/81.9 R
(58) Field of Search ..... 200/81 R, 81.4–81.6, 200/81.8, 81.9 R, 61.04, 61.25, 61.26, 85 A, 86 A

(56) References Cited

U.S. PATENT DOCUMENTS 3,644,919 A * 2/1972 Mathauser ..... 340/573.1
3,938,078 A * 2/1976 Davis et al. ..... 200/61.25
5,749,838 A * 5/1998 Kline ..... 601/71
6,021,863 A * 2/2000 Stanley ..... 180/273
6,286,861 B1 * 9/2001 Cech et al. ..... 380/735
6,476,514 B1 * 11/2002 Schondorf ..... 307/10.1

* cited by examiner

*Primary Examiner*—Karl D. Easthom
*Assistant Examiner*—M. Fishman

(57) ABSTRACT

Disclosed herein is an actuator and its method of manufacture, wherein the actuator comprises a flexible tubing comprising an amount of incompressible fluid contained in the inner portion of the flexible tubing; and a switch disposed on the top surface of an outer portion of the flexible tubing; wherein the actuator functions by moving the incompressible fluid through the tube such that a second force is directed onto the switch in response to a first force applied to the flexible tubing. Further disclosed is an actuating system comprising an actuator disposed between a first and second substrate, and an actuating system comprising a plurality of actuators.

3 Claims, 6 Drawing Sheets

ACTUATOR, METHOD OF MANUFACTURE AND APPLICATION OF USE

BACKGROUND OF THE INVENTION

Disclosed herein is a tube switch actuator. More particularly, disclosed herein is a tube switch actuator comprising an incompressible fluid, wherein the tube switch actuator signals to a switch by non-electrical means.

A variety of switch actuators exist wherein the actuators are used on a variety of control applications, for instance, they are installed on doors, machinery, equipment and under rugs to control the doors, machinery, equipment or operate burglar alarms, etc. Such actuators include, for example, mat and tape electric contact switches and air diaphragm type switches.

Conventional tape switch actuators generally comprise a pair of tapes or ribbons which are separated by one or more insulating strips so that they are not in contact. The assembly is covered by a plastic cover. When the tape switch is pressed at any point along its length by a hand, foot, vehicle wheel, etc., the contact will be made for controlling another circuit, for instance, for opening doors, operating burglar alarms and lights, operating counters, etc. Such conventional tape switches are described, for example, in U.S. Pat. Nos. 2,938,977; 3,052,772 and 3,710,054.

Conventional map switches generally incorporate switches into floor mats in the vicinity of machinery to open or close electrical circuits. For example, a floor mat switch which closes an electrical circuit when stepped on may be used as a safety device to shut down machinery when a person walks into an unsafe area in the vicinity of the machinery. Conversely, the floor mat switch can be used to close a circuit and thereby keep machinery operating only when the person is standing in a safe area. Alternatively, the floor mat switch may be used to sound an alarm when stepped on, or to perform some like function. Mat switches typically include an electrical contact disposed between two mat substrates. The electrical contact is operable under pressure between a closed condition and an open condition and is maintained in either the opened or closed condition in the absence of pressure. One of the substrates of the mat transmits activating compression to the electrical contact. The electrical contact is typically a ribbon switch that may either run continuously or intermittently along the perimeter of the substrates. The ribbon switch is composed of electrical conductors which electrically engage upon compressing the substrate to activate the switch.

Also known in the art are compressible piezoresistive materials which have electrical resistance which varies in accordance with the degree of compression of the material. Such piezoresistive materials are disclosed in U.S. Pat. Nos. 5,060,527, 4,951,985, and 4,172,216, for example.

Electric flat tapeswitches, typically utilized in mat switch constructions, have problems in flexibility. That is, these tapeswitches can only bend in an upward and downward fashion, and therefore, cannot be easily contoured to fit the shape of their respective attachment sites. Therefore, construction of mats and strip applications are complex and expensive as they require corner connectors, and to operate most industrial equipment, such as gate and door openers, the electric tapeswitch requires additional expensive step up relays. Additionally, these tapeswitches require a considerable amount of force needed to activate the corresponding signals.

Although air diaphragm type switches have removed the necessity for electrical tape switches, these switches require a large volume of compressible air to actuate a switch by a movement of a large diaphragm. This system has proven cumbersome and is not adequate for sensitive applications.

Therefore, what is required is an actuator having improved flexibility, reduced motion loss, increased sensitivity, and lower costs of manufacture. Further needed is an actuator that can signal a switch by non-electrical means, thereby removing those dangers inherent in electrical activity.

BRIEF SUMMARY OF THE INVENTION

The above problems are alleviated by an actuator comprising a flexible tubing comprising an amount of incompressible fluid contained in the inner portion of the flexible tubing; and a switch disposed on the top surface of an outer portion of the flexible tubing; wherein the actuator functions by moving the incompressible fluid through the tube such that a second force is directed onto the switch in response to a first force applied to the flexible tubing. Further disclosed herein is a method for forming the actuator described above.

BRIEF DESCRIPTION OF THE DRAWINGS

FIGS. 8–11depict cross-sectional views of exemplary positionings of an actuator, wherein the positioning assists in securing the actuator;

DETAILED DESCRIPTION OF THE PREFERRED EMBODIMENT

Figure 1:
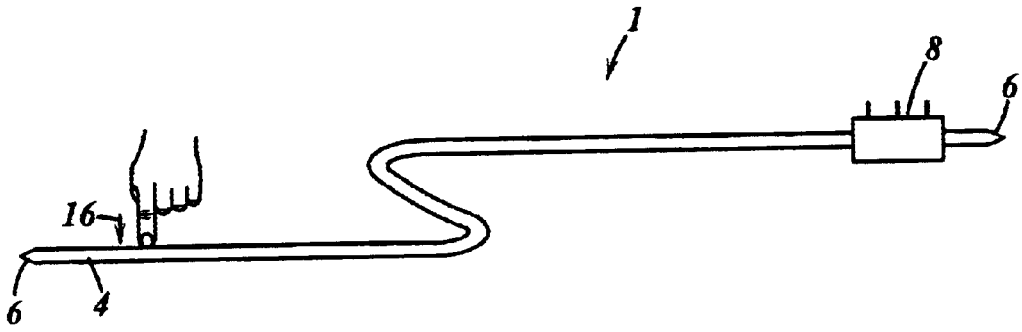
FIG. 1 depicts an elevational surface view of an exemplary actuator.

Disclosed herein is an actuator capable of sending signals to a switch by non-electrical means. Also, the actuator has greater physical flexibility and experiences lesser degrees of motion loss as compared to conventional actuators, thereby increasing the disclosed actuator's scope of application. Furthermore, the force used to trigger the actuator disclosed herein may be adjusted to increase or decrease the sensitivity of the actuator depending on a user's requirements.

The actuator disclosed herein comprises a flexible tubing and an incompressible fluid, wherein the incompressible fluid is contained in the flexible tubing. The actuator may further comprise a switch disposed on a portion of an outer surface of the flexible tubing. The actuator functions by detecting external forces applied to any portion of the outer surface of the flexible tubing. That is, when a sufficient force is applied to the flexible tubing, the exact force necessary to trigger the actuator determined by the user, the incompressible fluid in the flexible tubing is displaced towards an end of the flexible tubing, and the movement of the incompressible fluid associated with the displacement triggers the switch. The switch, in turn, may be connected to a signaling device, such as a light, a vibrational alarm, or an auditory alarm, to alert the user to the change in pressure. The switch may be connected to the signaling device by any variety of means, such as, for example, by electrical means.

The flexible tubing comprises a hollow tube formed of any material capable of resisting stretching and expansion, and which is also capable of absorbing the motions and force of the incompressible fluid. Preferred flexible tubings comprise those materials having a durometer of Shore A of about 55 to about 60. As used herein and throughout, "durometer" refers to the measure of the flexible tubing's surface resistivity. Although the tubings may comprise durometers less than about 55 to about 60, these tubings tend to absorb transfer forces, and result in overall lower quality performances. Tubings above this durometer range are also acceptable; however, such tubings tend to require larger amounts of force to activate the actuator.

The choice of material for the flexible tubing should also take the temperature of the environment in which the actuator will be used into consideration. That is, as particular materials are prone to constrict or contract upon changes in temperature, the material should be chosen so as to eliminate variances in the surface area and other dimensions of the flexible tubing.

In a particularly preferred embodiment, the flexible tubing comprises natural or synthetic rubbers, such as, polyvinyl chloride (PVC), silicone, ethylene propylene diene, and compositions including at least one of the foregoing. A particularly preferred flexible tubing comprises PVC and is available from Tygon® Laboratory Tubing as formulation R-3603. Such tubings, are able to withstand temperatures ranging from about −50° C. to about 73° C.

Furthermore, the flexible tubing may comprise a wide variety of sizes. For example, the flexible tubing may comprise a length of about 0.063 feet to about 80 feet. Within this range, a flexible tubing comprising a length of greater than or equal to about 0.083 feet is preferred, with greater than or equal to about 0.125 feet more preferred, and greater than or equal to about 0.167 feet especially preferred. Also within this range, a length of less than or equal to about 70 feet is preferred, with less than or equal to about 60 feet more preferred, and less than or equal to about 50 feet especially preferred.

Additionally, the flexible tubing may be of any diameter so long as the diameter is not so large such that the incompressible fluid contained within the flexible tubing creates a motion in the flexible tubing upon displacement of the incompressible fluid. In a preferred embodiment, the flexible tubing has a thickness determined by the ratio of the inner diameter to the outer diameter of the flexible tubing, such that the outer diameter of the flexible tubing is about 7 to about 12% greater than the inner diameter of the flexible tubing, wherein an outer diameter that is about 10% greater than the inner diameter of the flexible tubing is particularly preferred. A particularly preferred outer diameter comprises less than or equal to about 0.5 inches, with less than or equal to about 0.25 inches more preferred. Additionally, a particularly preferred inner diameter comprises less than or equal to about 0.23 inches, with less than or equal to about 0.19 inches more preferred.

The incompressible fluid may comprise any liquid having less than 1 volume percent of a gas based on the total volume of the incompressible fluid. Preferably, the incompressible fluid comprises a sufficient viscosity such that the incompressible fluid, in response to an applied pressure, can move in the flexible tubing with a minimal amount of frictional loss. Although the viscosities may vary widely, preferably, the incompressible fluid comprises a dynamic viscosity at 20° C. of about 1 to about 30 centipoises, wherein the larger dynamic viscosity fluids are preferred when larger amounts of force are desired to initiate the actuator. The chosen incompressible fluid should also be adapted to the environment in which the actuator will be utilized. For example, in environments below the freezing temperature of water, incompressible fluids having a freezing point below that of water should be utilized. Particularly preferred incompressible fluids comprise, for example, water, alcohol, hydraulic oils, anti-freeze solutions, and combinations comprising at least one of the foregoing.

The switch may comprise any device having the proper geometrical dimensions and capacities such that the switch may be attached to the actuator, and whereupon receiving a signal from the actuator the switch may respond as desired by the user. For example, the switch may be used to transmit a visual, vibrational, or audio signal to the user. Preferably, the switch comprises a surface length of up to about 1 inch, with up to about 0.75 inch preferred, and up to about 0.50 inch more preferred, and up to about 0.25 inch especially preferred, wherein the surface length of the switch rests on a portion of the flexible tubing's surface. Additionally, the switch may operate either electrically or pneumatically. That is, the switch may comprise, for example, a normally-closed switch, a normally-open switch, or an air diaphragm switch.

The incompressible fluid may be placed into the hollow portion of the flexible tubing by a variety of methods. An important consideration when filling the flexible tubing with the incompressible fluid is to limit the existence of vacuums or air pockets in the flexible tubing, which serve to obstruct or hinder the incompressible fluid from transferring the touch pressure at any point along the flexible tubing. It is important to note that air pockets may develop after the flexible tubing has been filled with the incompressible fluid due to normal expansion and contraction of the flexible tubing in response to environmental working conditions. Accordingly, disclosed herein is a method for eliminating the occurrence of such air pockets during the course of the life-span of the actuator.

Such vacuums or air pockets may be eliminated to any appreciable extent by following the exemplary method detailed below. In this exemplary method, the incompressible fluid is placed within the hollow portion of the flexible tubing under positive pressure. In this method, an open end of the flexible tubing is preferably hooked onto an incompressible fluid supply valve. The incompressible fluid is preferably allowed to run through the entire length of the flexible tubing until there are no noticeable air bubbles or air pockets remaining in the flexible tubing. The second open-end of the flexible tubing may then be clamped. After clamping the second-end of the flexible tubing, the incompressible fluid is allowed to flow into the flexible tubing until a sufficient pressure is built up in the flexible tubing. Although the pressure may vary widely, a preferred pressure is from about 1 to about 8 pounds per square inch ("psi"), with a pressure of about 2 to about 7 psi more preferred, and about 4 to about 6 psi especially preferred. Once having obtained the desired pressure, the remaining open-end of the flexible tubing is clamped. The end portions may then be sealed, preferably in a permanent fashion, such as by heat sealing and/or by crimping the clamps.

The switch may then be applied to the surface of the flexible tubing by a variety of methods. One such method includes using a bracket to secure the switch onto the flexible tubing. Such brackets are standard in the art, and may comprise any plastic or metallic material for example. Although the switch may be positioned anywhere along the length of the flexible tubing, for ease of use, it is preferred that the switch is placed as close as possible to one of the sealed ends of the flexible tubing. Preferably, the actuator is placed within about 5 inches from the end of the flexible tubing, with about 2 inches from the end of the flexible tubing more preferred, and with about 1 inch from the end of the flexible tubing especially preferred.

As previously stated, the actuator performs by detecting a force applied to a portion of the exterior surface of the flexible tubing. The amount of force necessary to activate the actuator into signaling a response to the switch may be readily fixed and altered by a user. Preferably the actuator can respond to forces of about 5 ounces up to about 20 pounds on a ¼ square inch of the tubing. It is noted that in a preferred embodiment, the same amount of force may be exerted along any point of the surface of the tubing to activate the actuator in the same amount of time.

Additionally, the actuator may further comprise an adjustor, wherein the adjustor serves as a means for further adjusting the amount of force needed to activate the actuator. The adjustor functions by applying a predetermined amount of force to a portion of the exterior surface such that the actuator is placed in a prestressed condition. A smaller amount of force, then is required to activate the actuator when in this prestressed condition. The adjustor, for example, may be able to reduce the amount of force from 10 pounds on a ¼ square inch to 5 ounces on a ¼ square inch of the flexible tubing. The adjustor may comprise a wide variety of materials, such as a metal, a plastic, a rubber material, and the like; and may include a wide variety of forms, such as, for example, a screw.

The invention will now be described in reference to the Figures, wherein it is understood that the Figures merely represent exemplary embodiments of the invention, and, therefore, that deviations and modifications of these embodiments is contemplated.

Figure 2:
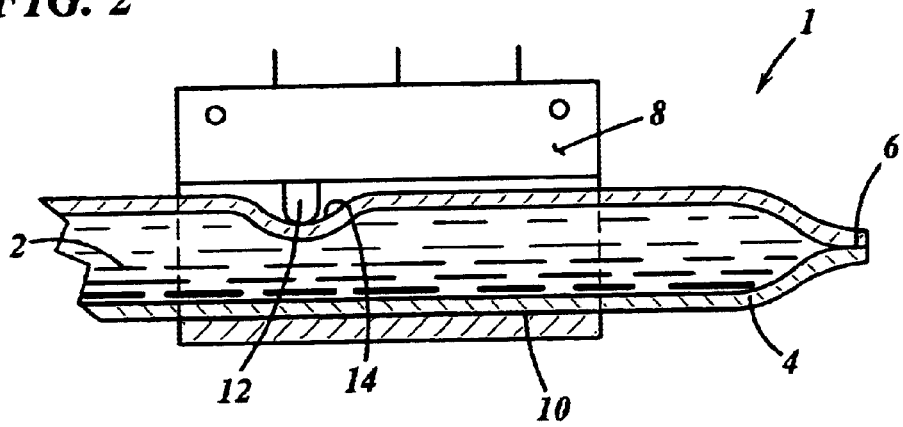
FIG. 2 depicts a cross-sectional view of the exemplary actuator of FIG. 1.

Referring to FIGS. 1 and 2, an exemplary actuator is shown. In FIGS. 1 and 2, an actuator 1 comprises an incompressible fluid 2 contained in a flexible tubing 4. Both ends of flexible tubing 4 are sealed to form sealed ends 6. Sealed ends 6 may be closed by any one of several methods. For example, the ends of the flexible tubing may be heat sealed, or an end(s) of the flexible tubing may be placed thorough a metallic ring, wherein the ring is then crimped to seal the flexible tubing. A switch 8 is disposed on the surface of flexible tubing 4.

As shown in FIG. 2, switch 8 comprises a movable plunger 12. Plunger 12 extends from the bottom of switch 8 where it forms and rests on a groove 14 of flexible tubing 4. Referring to FIGS. 1 and 2, when a force 16 is applied to the exterior surface of flexible tubing 4, incompressible fluid 2 moves in a bidirectional fashion to both sealed ends 6 of flexible tubing 4. As incompressible fluid 2 moves across and away from groove 14, an upward pressure is exerted onto plunger 12, such that plunger 12 is pushed upward into switch 8 thereby activating the circuitry in switch 8 necessary for eliciting a desired response.

Figure 3:
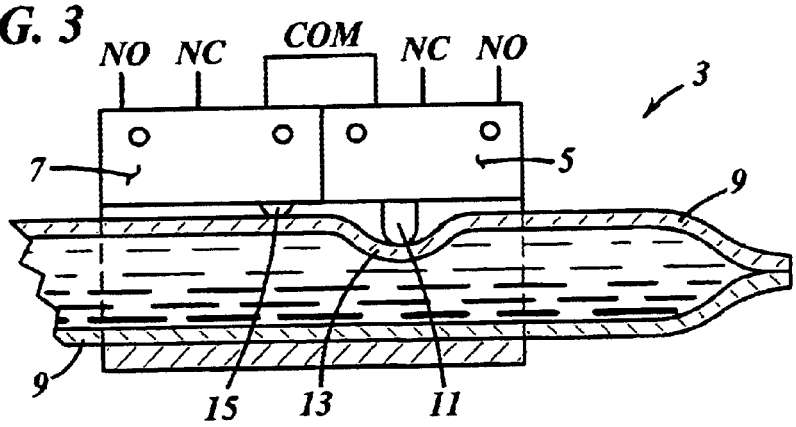
FIG. 3 depicts a cross-sectional view of an exemplary actuator.

Another exemplary embodiment of an actuator is depicted in FIG. 3. Here, an actuator 3 comprises a first switch 5 and a second switch 7 disposed on a surface of a flexible tubing 9. First switch 5 comprises a plunger 11 depressed into a groove 13 of flexible tubing 9. Second switch 7 comprises a plunger 15 that is not depressed in normal operating conditions. Second switch 7 serves as a fail-safe switch, such that if first switch 5 fails to function or if there is a problem with flexible tubing 9, second switch 7 can signal to the user such problems. In a preferred embodiment, when first switch 5 is normally-open, second switch 7 is normally-closed or vice versa.

Figure 4:
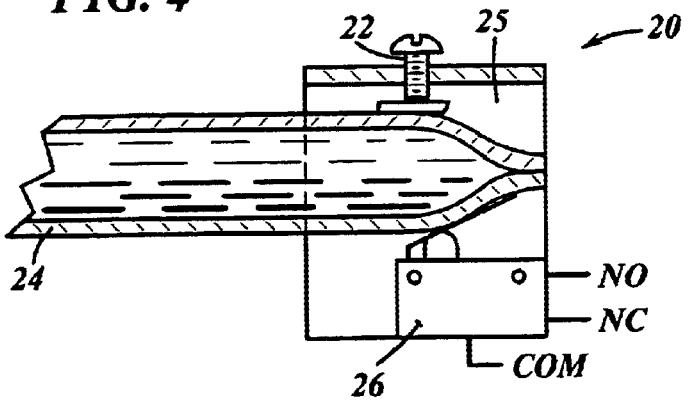
FIG. 4 depicts a cross-sectional view of an exemplary actuator.

FIG. 4 depicts yet another exemplary embodiment of an actuator 20 comprising an adjustor 22 disposed on the end of a flexible tubing 24 opposite to a switch 26, wherein switch 26 and adjustor 22 are secured onto flexible tubing 24 by a clamp 25. The adjustor serves as a means by which to control the amount of force necessary to activate the actuator. That is by exerting a variable amount of force on the outer surface of the flexible tubing, the adjustor places the actuator in a prestressed condition. Accordingly, an amount of an external force required to activate the actuator will be in relation to the amount of force exerted on the tubing by the adjustor, wherein the greater the amount of force exerted by the adjustor, the lesser amount of external force required to activate the actuator. Therefore, by altering the position of the adjustment screw, the amount of force necessary to activate the switch may be controlled. Although FIG. 4 depicts adjustor 22 at an end of flexible tubing 24, it is noted that the adjustor may be positioned anywhere along the surface length of the flexible tubing. It is additionally noted that various embodiments of the adjustor are contemplated, and that the depicted screw structure is not limiting.

Figure 5:
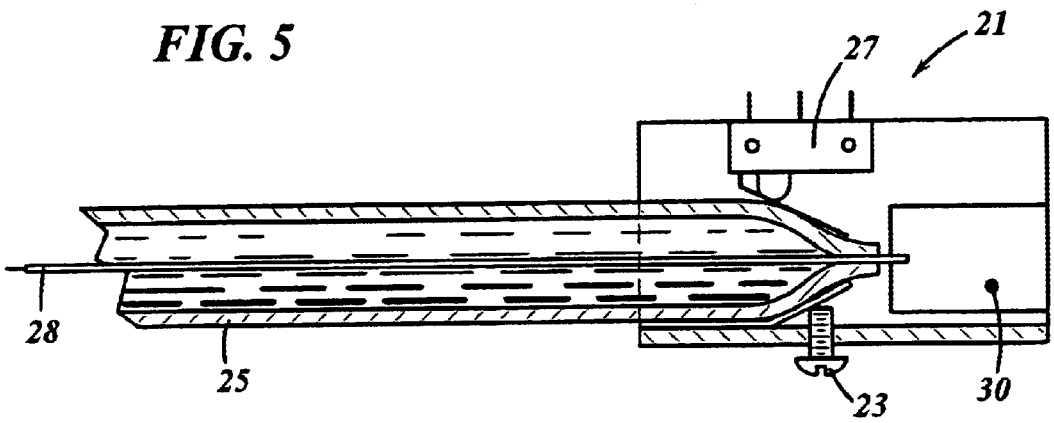
FIG. 5 depicts a longitudinal section of an exemplary actuator.
Figure 6:
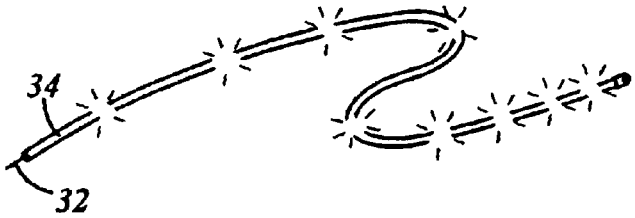
FIG. 6 depicts a longitudinal section of an exemplary actuator.

FIG. 5 depicts an exemplary actuator 21 comprising an adjustor 23 disposed on a side of flexible tubing 25 directly opposite to a switch 27. Actuator 21 further comprises a wire 28 inserted through flexible tubing 25 and connected to a circuit 30. Wire 28 may be used for a variety of means, such as, but not limited to, emitting light, emitting auditory notes, and emitting vibrational movement from flexible tubing 24. The light emitting concept is more specifically depicted in FIG. 6. Here a luminescent circuit is established by means of a wire 32, which is inserted through a flexible tubing 34 and connected to a circuit (not shown) contained within an enclosed area outside of flexible tubing 34.

Figure 7A:
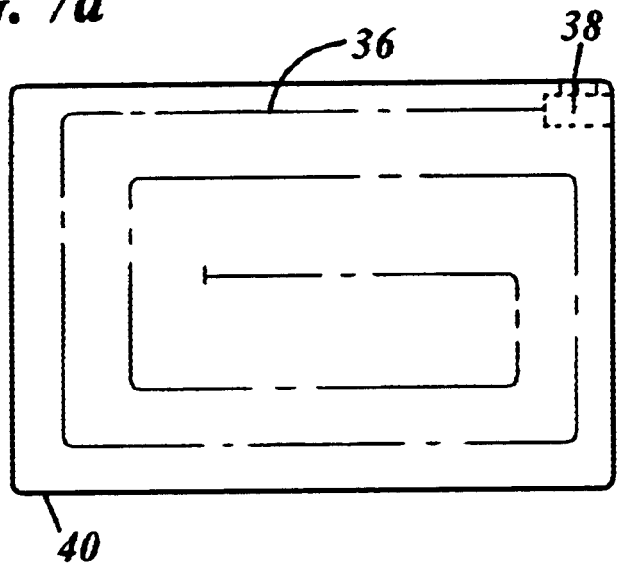
FIG. 7*a* depicts an elevational surface view of an exemplary tube switch actuator system.
Figure 7B:
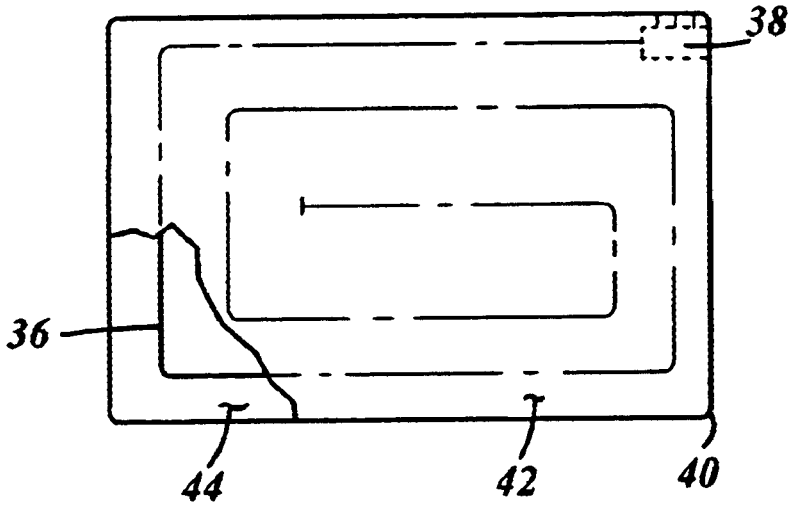
FIG. 7*b* depicts an elevational surface view of the actuator system shown in FIG. 7*a;*
Figure 7C:
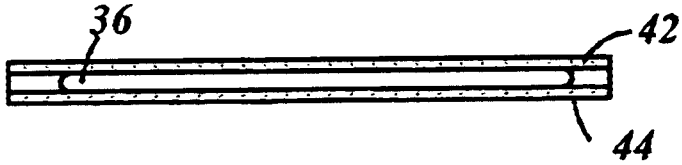
FIG. 7*c* depicts a cross-sectional view of the actuator system shown in FIGS. 7*a* and 7*b;*

The actuator as described herein may be positioned along any surface that the user desires to be monitored. Additionally, the actuator may be enveloped in a device to form an actuator system wherein the actuator system is positioned on the surface to be monitored. FIGS. 7*a*, 7*b*, and 7*c* depict an exemplary embodiment of an actuator system. FIGS. 7*a* and 7*b* depict an actuator comprising a flexible tubing 36 and a switch 38 contained within a mat 40. As shown in FIGS. 7*b* and 7*c*, mat 40 comprises a top cover 42 and a bottom cover 44, wherein bottom cover 44 may be disposed on an anchor surface (not shown), and wherein the force that stimulates the actuator may be exerted over at least a portion of top cover 42.

Mat 40 may comprise any material currently known and may comprise a wide variety of geometrical shapes, including for example, rectangular, square, circular, elliptical, oval, and polygonal. The flexibility of the flexible tubing makes the actuator particularly useful in this application, as the flexible tubing may be configured well within the geometrical shape and dimension of the mat. In a preferred embodiment, the mat comprises a thickness of about 0.0625 inch to about 0.25 inch. Furthermore, The mat may comprise a wide variety of lengths and widths. Additionally, the mat can be made to operate under a wide variety of forces. For example, the mat may be made to operate to withstand forces of about 1 pound to about 50 psi of the mat.

As alluded to above, the actuator disclosed herein may be disposed within a variety of differently shaped substrates. Such disposal is useful for fixing the actuator in place and for relieving unwanted stresses from the actuator. Exemplary configurations for stabilizing the motion of the actuator are depicted in FIGS. 8–11.

Figure 8:
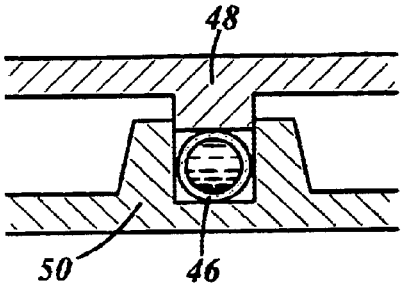

As shown in FIG. 8, a flexible tubing 46 of the actuator may be positioned in a controlled limiting channel that can limit the force applied to the flexible tubing by enclosing flexible tubing 46 between two substrates 48, 50. When a force is applied to either of substrates 48, 50, the respective substrate moves towards the opposing substrate to apply a force onto flexible tubing 46.

Figure 9:
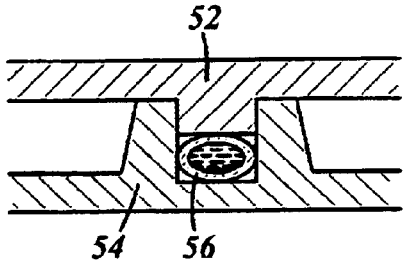

As shown in FIG. 9, substrates 52 and 54 envelope a flexible tubing 56 of an actuator. Flexible tubing 56 is activated by applying a force to either of substrates 52 and 54 which then can send an activating vibrational force towards flexible tubing 56.

Figure 10:
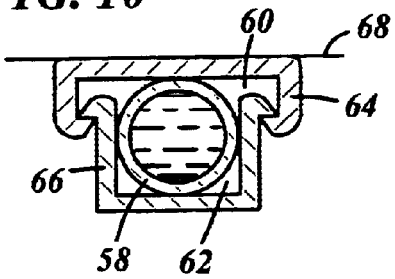

FIG. 10 depicts an alternative embodiment for controlling the movement of the actuator and for controlling the amount of force sufficient to activate the switch. Here, a flexible tubing 58 of an actuator is contained within two channels 60, 62 formed from two substrates 64, 66 respectively. Substrate 64 is shown disposed on an anchor surface 68. When a sufficient force is exerted on substrate 64, the actuator may signal to the switch (not shown).

Figure 11:
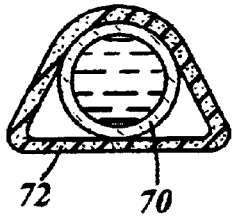

FIG. 11 depicts yet another exemplary embodiment for controlling the movement of the actuator. Here, a flexible tubing 70 is disposed through a foam extrusion 72. Foam extrusion 72 is sufficiently pliable such that it makes for a good application of the actuator on those structures where flexibility in mounting is desirable, such as around, doors and windows.

Figure 12:
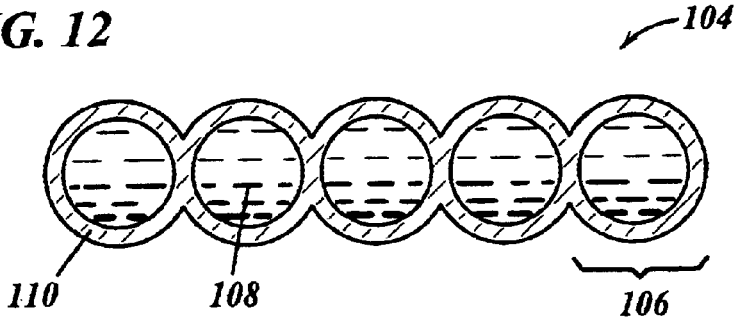
FIG. 12 depicts a cross-sectional view of an exemplary plurality of actuators.

It is further contemplated herein that an actuator system may be formed comprising a plurality of actuators, wherein each actuator forming the plurality may be physically joined to at least one other actuator forming the plurality, and further wherein the plurality comprises two or more actuators. An exemplary embodiment of a plurality of actuators is depicted in FIG. 12. As shown in FIG. 12, a plurality of actuators 104 comprises individual actuators 106, wherein each of individual actuator 106 comprises an incompressible fluid 108 disposed within the hollow portion of a flexible tubing 110. Such an assembly assists in a cost-effective development of an actuator system capable of managing a number of different switches.

Figure 13:
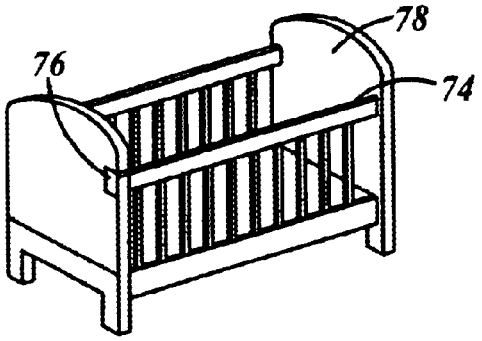
FIGS. 13–18 depict exemplary applications of the actuator.

The actuator disclosed herein has a wide variety of applications as shown, for example, in FIGS. 13–18. FIG. 13 depicts an actuator comprising a flexible tubing 74 connected to a switch 76 disposed on a crib 78, such that when an infant applies sufficient force, e.g., a force necessary to climb out of crib 78, to flexible tubing 74, switch 76 will activate an alarm (not shown).

Figure 14:
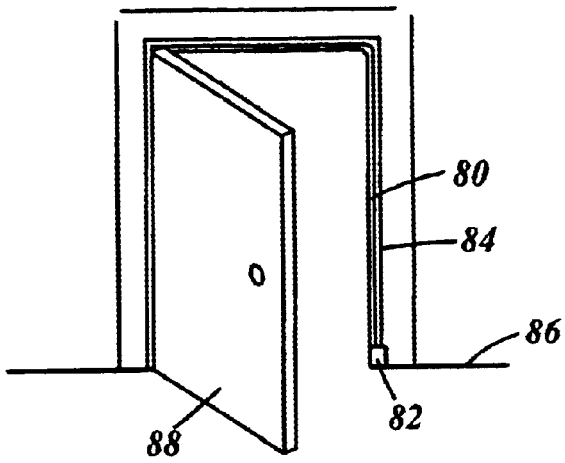

FIG. 14 depicts an actuator comprising a flexible tubing 80 and a switch 82, wherein flexible tubing 80 is disposed along a length of a door frame 84, and switch 82 is mounted on the door frame 84 nearest to a floor 86. According to this embodiment, when a door 88 is opened or closed, the force from such motion is used to activate switch 82 via the actuator.

Figure 15:
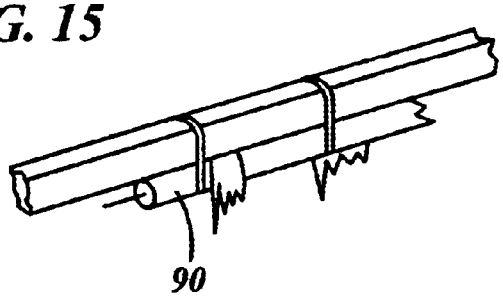

FIG. 15 depicts an actuator comprising a flexible tubing 90 utilized to detect temperature changes. In this embodiment, incompressible fluid in flexible tubing 90 expands upon exposure of the actuator to increasingly colder temperatures. Upon reaching a predetermined expansion, the switch (not shown) may be activated to alert the user that a particular temperature has been reached.

Figure 16:
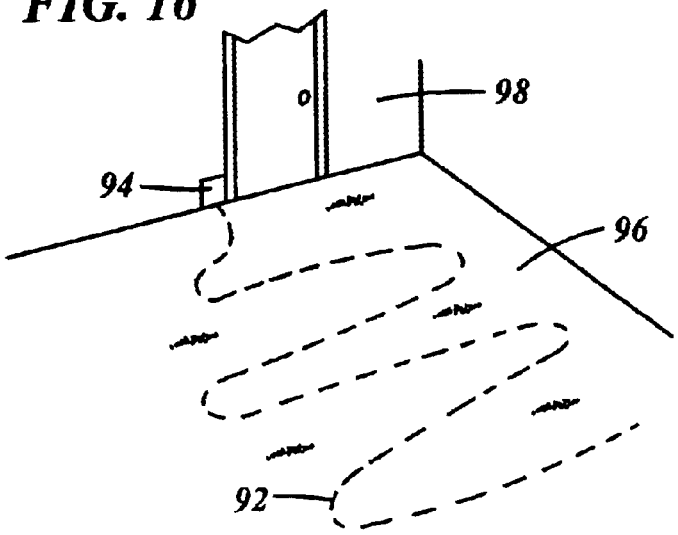

FIG. 16 depicts an actuator comprising a flexible tubing 92 patterned in a winding fashion underneath a carpet 96. Flexible tubing 92 is connected to a switch 94 that is mounted against a wall 98. This embodiment, therefore, is particularly useful when monitoring motion on a floor. This embodiment also shows the great flexibility of the actuator and the manner in which it may be coiled or contorted without affecting the operability of the actuator.

Figure 17A:
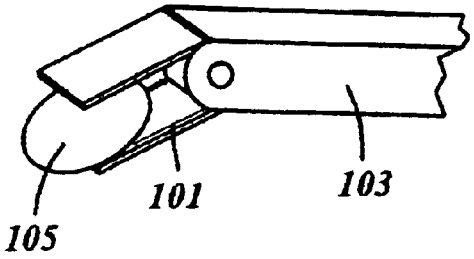
Figure 17B:
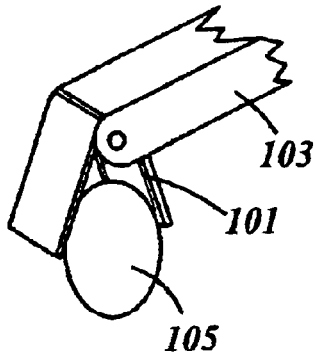
Figure 17C:
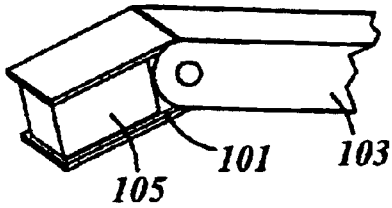
Figure 17D:
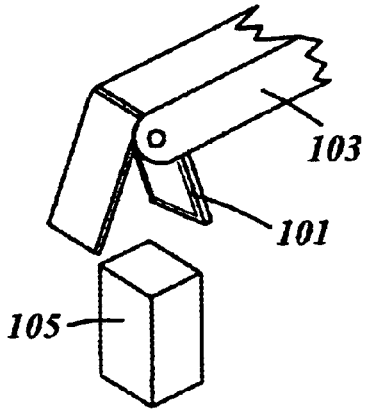
Figure 18:
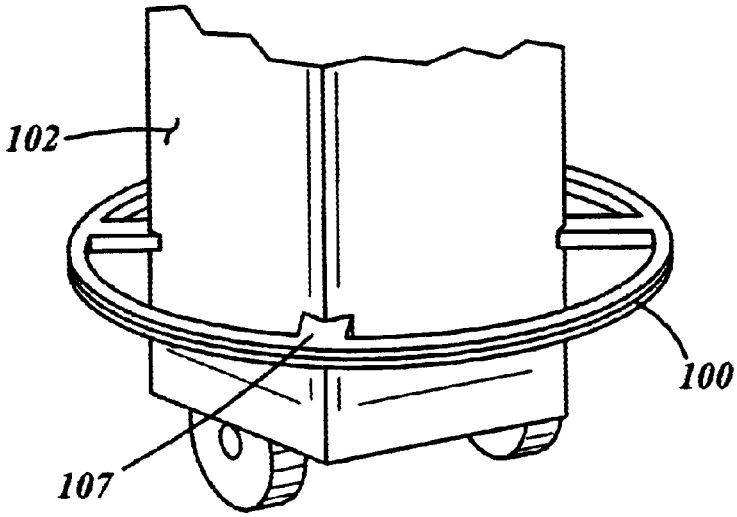

FIGS. 17*a*–17*d*, depict an application of an actuator 101 disclosed herein wherein the actuator may be computer operated to grip items with varying sensitivity when used in robotics. Here an actuator 101 may indicate to a robotic arm 103 as to how firmly robotic arm 103 may hold an object 105, and when to release object 105 (FIG. 17*d*). Furthermore, FIG. 18 depicts an actuator 100 comprising a switch 107 mounted 360° around a roving robotic unit 102. This feature is shown in particular to stress the flexibility of the actuator and to indicate that the actuator may be disposed in a straight linear fashion or in a patterned fashion along a surface to be monitored.

Having described the preferred embodiment of the invention with reference to the accompanying drawings, it is to be understood that the invention is not limited to these precise embodiments in that various changes and modifications may be effected therein by one skilled in the art without departing from the scope or spirit of the invention.

The actuator is further described by the following non-limiting examples:

EXAMPLES

Example 1

Method of Forming an Actuator Without Pressurizing the Incompressible Fluid Prior to Sealing A 0.25 inch outer diameter ("OD")×0.187 inch inner diameter ("ID")×20 foot piece of flexible PVC Tygon® Chemical flexible tubing was filled with a water-alcohol solution (50 parts water/50 parts alcohol) and sealed at both ends. The flexible tubing was mounted to a 0.125 inch×24.0 inch×36.0 inch rigid PVC sheet in a square coiled pattern. The mounting was accomplished by means of a PVC adhesive obtainable from 3M™ scotch-grip, No. 2262 plastic adhesive. A 10 ampere, 120 volt alternating current normal open-normal closed switch was attached to the flexible tubing so as to allow the switch plunger to press against the flexible tubing without actuating the switch. An adjustor in the form of a screw was applied to the flexible tubing opposite to the plunger to adjust the amount of force required to activate the switch. A 0.125 inch×24.0 inch×36.0 inch top rigid PVC sheet was placed over the flexible tubing on a side opposite to the first PVC sheet.

Pressure tests were made to the assembly by applying various forces at various areas of the assembly. By adjusting the adjustment screw, the psi could be controlled from about 1 psi to about 50 psi.

Example 2

Method of Forming an Actuator by Pressurizing the Incompressible Fluid Prior to Sealing A 0.25 inch OD×0.187 inch ID×5 foot piece of flexible PVC Tygon® Chemical flexible tubing was filled with a water-alcohol solution (50 parts water/50 parts alcohol) under 4 psi and sealed. A 5 ampere, 120 volt alternating current normal open-normal closed switch was attached to the end of the flexible tubing with an adjustor in the form of a screw. The actuator was tested by applying force at different points along the flexible tubing. The tests indicated that the force required to activate the switch along the flexible tubing could be varied from a few ounces, e.g., about 5 ounces, to many pounds, e.g., about 10 pounds.

Various mat substrates were placed over the flexible tubing and were tested with excellent results. One mat substrate comprised a 0.0625 inch height ("H")×1.0 inch wide ("W")×6.0 inches long ("L") rigid PVC, wherein the PVC was obtained from McMaster-Carr Supply Co., catalogue #8747K111. Another mat substrate comprised a 0.125 inch (H)×1.0 inch (W)×6.0 inches (L) rigid PVC, wherein the PVC was obtained from McMaster-Carr Supply Co., catalogue #8747K112. A third mat substrate comprised a 0.5 inch (H)×0.75 inch (W)×6.0 inches (L) hollow ½ round foam rubber extrusion, wherein the foam rubber door seal extrusion was obtained from McMaster-Carr Supply Co., catalogue #93085K68. It was found that lower amounts of pressure and movement were required to actuate the switch for the more rigid mat substrates. This is due to the greater displacement of the incompressible fluid in the flexible tubing, which is an advantage over the prior art as the prior art electrical tape switches increase force with increased pressure area.

Example 3

Comparison of Incompressible Fluid Materials

Various incompressible fluids, i.e., hydraulic oil, antifreeze incompressible fluids, and water, were sealed in a variety of PVC and rubber tubes from 0.25 inches to 0.395 inches OD to determine the ratio of transference forces and friction loss to actuate a switch. The smallest OD thin wall flexible tubing, having minimum expansion and elongation, functions the best with minimum friction and minimal motion losses. Flexible rubber absorbed the actuation force by expanding and elongating, rather than transmitting the actuation force to the switch.

The various incompressible fluids that were tested are listed below in Table 1:

TABLE 1

Incompressible Fluids Used to Test Frictional Loss in the Flexible Tubing

| |
|---|
| Hydraulic Jack Oil - sold by Gold Eagle Co.; Chicago, IL 60614 |
| 50% Ethanol/50% Water solution |
| 3 In One Oil - sold by WD-40 Company; San Diego, CA 92110 |
| Turbo Power Windshield Washer Fluid - sold by Recochem Inc.; Canada |

It was observed that, when sealed in the same size and type of flexible tubing, the ethanol/water solution and the windshield washer fluid required less force to squeeze the flexible tubing than that required by the oils. Rather, the oils required about 20% more pressure to actuate a switch. Therefore, depending on the user's ultimate needs, and the force necessary to activate the switch, the user may select the incompressible fluid accordingly.

Pressure tests conducted on various types of flexible tubing are shown below in Table 2:

TABLE 2

Force Required to Completely Flatten a Flexible Tubing

| Flexible Tubing Material | Tubing Size (inches) Outside Diameter | Tubing Size (inches) Inside Diameter | Force Applied (pounds) | Ability to completely flatten when a force is applied over 0.25 square inches of the flexible tubing's surface: Results |
|---|---|---|---|---|
| PVC Tygon Shore A 55* | 0.1875 | 0.125 | 8 | Poor |
| PVC Tygon Shore A 55* | 0.25 | 0.1875 | 2 | Good |
| PVC Tygon Shore A 55* | 0.3125 | 0.1875 | 11 | Poor |
| PVC Tygon Shore A 55* | 0.375 | 0.25 | 8 | Poor |
| PVC Tygon Shore A 55* | 0.5 | 0.375 | 10 | Good |
| Latex Rubber Shore A 35* | 0.1875 | 0.125 | 2–11 | Poor |

*Material supplied from McMaster Carr, Supply Co.

As used in Table 2, "Good" test results indicate that the flexible tubing was able to completely flatten when the stated force was applied to 0.25 square inches of the flexible tubing. "Poor" test results indicate that the flexible tubing was not able to completely flatten when the stated force was applied to 0.25 square inches of the flexible tubing.

Based on this data, it is clearly shown that durometers Shore A's of 35 are inadequate materials for use in the actuator described herein. This is most likely attributable to the fact that flexible tubings formed from materials having such durometers absorb the press force by elongating, rather than by remaining rigid and passing the force on to the incompressible fluid.

Example 4

A Method for Forming an Exemplary Light Emitting Device

The flexible tubing containing the water-alcohol solution, both as described in Example 2, was inserted with a light emitting wire and the and scaled. The light emitting wire was obtained from "Live Wire Enterprise" located in Flushing, N.Y. A 5 ampere, 120 volt momentary normally-opened push-button switch was placed against the flexible tubing wall and, with the light emitting wire glowing, the switch could be actuated by lightly pressing along any point of the flexible tubing.

Therefore, disclosed herein is an actuator having several benefits over conventional actuators. The actuator disclosed herein is flexible, and may, therefore, be applied over a wide variety of surfaces and may take on a wide variety of configurations without affecting the operation of the actuator. The actuator disclosed herein allows for greater sensitivity such that lesser amounts of force are sufficient to activate the actuator. Also, the amount of force required to activate the actuator may be readily adjusted and varied by the user. The actuator also provides a non-electrical means by which to communicate with the switch, thereby eliminating the dangers inherent in conventional electrical tapeswitches. The actuators are also easier and more cost-effective to manufacture than are conventional actuators as the need for providing electrical conductors is eliminated.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An actuating system comprising:

a first substrate comprising a cross-sectional area having a cavity;

a second substrate comprising a cross-sectional area having a first protrusion; and an actuator disposed at least partially between the first and second substrates, wherein the actuator comprises:

a flexible tubing comprising:

a first sealed end;

a second sealed end;

an outer portion comprising a top spice and a bottom surface; and an inner portion;

an amount of incompressible fluid contained in the inner portion of the flexible tubing;

wherein at least a portion of the bottom surface of the flexible tubing is disposed on at least a portion of a surface of the cavity and at least a portion of the first protrusion of the second substrate is disposed on at least a portion of the top surface of the flexible tubing.

2. The actuating system of claim 1, wherein the first substrate further comprises a second protrusion and a third protrusion, wherein the second and third protrusions form an upper boundary of the cavity, and wherein the second and third protrusions of the first substrate are in physical communication with the first protrusion of the second substrate.

3. An actuating system comprising:

a first substrate comprising a cross-sectional area having a first cavity;

a second substrate comprising a cross-sectional area having a second cavity; and an actuator disposed at least partially between the first and second substrates, wherein the actuator comprises:

a flexible tubing, wherein the flexible tubing is at least partially disposed within the first and second cavities, and further wherein the flexible tubing comprises:

a first sealed end;

a second sealed end;

an outer portion comprising a top surface and a bottom surface; and an inner portion;

an amount of incompressible fluid contained in the inner portion of the flexible tubing; and a switch disposed on the top surface of the outer portion of the flexible tubing.

* * * * *

UNITED STATES PATENT AND TRADEMARK OFFICE

CERTIFICATE OF CORRECTION

PATENT NO. : 6,812,417 B1
DATED : November 2, 2004
INVENTOR(S) : Walter Carl Lovell It is certified that error appears in the above-identified patent and that said Letters Patent is hereby corrected as shown below:

Title page,
Item [75], Inventor, inventorship should be amended to read:
-- Walter Carl Lovell, deceased, late of Wilbraham, Massachusetts, by Donna M. Lovell, executrix. --

Signed and Sealed this

First Day of February, 2005

JON W. DUDAS
*Director of the United States Patent and Trademark Office*